United States Patent [19]

Donigian

[11] 4,103,659

[45] Aug. 1, 1978

[54] IGNITION SYSTEM

[76] Inventor: Donald S. Donigian, 6016 West Fullerton, Chicago, Ill. 60639

[21] Appl. No.: 658,185

[22] Filed: Feb. 17, 1976

Related U.S. Application Data

[63] Continuation-in-part of Ser. No. 494,453, Aug. 5, 1974, abandoned.

[51] Int. Cl.[2] ..... F02P 1/00

[52] U.S. Cl. ..... 123/148 DC; 123/148 AC; 315/209 M; 324/17

[58] Field of Search ..... 123/148 AC, 148 DC, 123/148 E, 148 R; 324/16 T, 17; 315/209 R, 209 T, 209 M, 224

[56] References Cited

U.S. PATENT DOCUMENTS

| | | | |
|---|---|---|---|
| 2,030,228 | 2/1936 | Randolph et al. | 123/148 DC |
| 2,963,624 | 12/1960 | Meyer, Jr. et al | 315/209 R |
| 3,007,082 | 10/1961 | Kappele | 123/148 E |
| 3,045,148 | 7/1962 | McNulty et al. | 315/209 M |
| 3,047,728 | 7/1962 | Martin | 123/148 DC X |
| 3,271,593 | 9/1966 | De Vilbiss | 315/209 SC |
| 3,327,165 | 6/1967 | Hawthorne | 123/148 AC X |
| 3,394,689 | 7/1968 | Bell | 123/148 E |
| 3,671,805 | 6/1972 | Schuette | 123/148 E X |
| 3,673,998 | 7/1972 | Phillips | 123/148 R |
| 3,699,940 | 10/1972 | Vargas | 123/148 CB |
| 3,753,428 | 8/1973 | Phillips | 123/148 E |
| 3,788,293 | 1/1974 | Anderson | 123/148 AC |
| 3,818,253 | 6/1974 | Chafer et al. | 315/209 T X |

FOREIGN PATENT DOCUMENTS

| | | | |
|---|---|---|---|
| 558,101 | 9/1932 | Fed. Rep. of Germany | 324/17 |
| 444,201 | 3/1936 | United Kingdom | 123/148 P |

*Primary Examiner*—Charles J. Myhre
*Assistant Examiner*—Tony M. Argenbright

[57] ABSTRACT

An improvement in the electrical circuitry of ignition systems for internal combustion engines wherein a new ignition pulse is provided from the surge voltage developed in the ignition coil of the ignition system. The new ignition pulse output signal is gated to provide for a single unit unidirectional impulse of the required polarity followed by an extended quiescent interval without sustaining voltages. Voltage regulation and stabilization is included for consistent outputs in the full range of the operating revolutions of the engine as well as an indicating monitor for indicating the system performance and existence of ignition voltage in the circuit.

4 Claims, 6 Drawing Figures

IGNITION SYSTEM

This application is a continuation-in-part of my copending application, Ser. No. 494,453, filed Aug. 5, 1974, now abandoned, on an Ignition System.

SUMMARY OF THE INVENTION

Recognizing the inherent problems and inefficiencies of the existing type ignition systems for internal combustion engines, many new innovations, including means for initiating ignition voltages, have been developed, with considerable sacrifice in simplicity and reliability. These improvements, consisting of many components, have been added to the basic requirements of an ignition system, all contained in complicated and sophisticated circuitry which has done nothing more than create confusion for servicers and users alike. These circuitries have had little concern for emergency conditions, such as the hazards of ignition failure while driving vehicles having power-assisted steering and brakes, while the inherent problems continue to be fade-outs, fallouts, spark quenching, and timing drift, these problems being increased by the variables in the gas resistance to the spark.

The object of this invention is to provide an improved ignition voltage output which will improve the timing and performance of the internal combustion engine. The improved circuit omits any type of suppressor which in the past has been added to existing systems to suppress surges and oscillatory currents following the initial ignition pulse surge.

It is an object of this invention to resolve these problems and provide for consistent and reliable means for burning of the gases within the internal combustion engine.

Since the output voltage bears the initial responsibility in an ignition system, the first requirement is to provide for a reliable means of delivering ignition voltage to the gas, and this is accomplished with a change in the nature and character of the electrical voltage applied to the gas, i.e., the output voltage wave form.

In order to clarify the principal object of this invention and the significance of the output voltage wave change resulting therefrom, the following axiomatic statements are made. The nature and character of the electrical voltage in the gas determines the catalytic and chemical reaction before the spark is introduced thereto, and this in turn influences the burn of such gas. These reactions include fuel atomization and gas ionization, which are herein defined as gas resistance, and is the load presented to the ignition current. The composition of the fuel-air being largely electron negative, molecular combinations occur, producing ions and new compounds in the gas, which affect burn and emissions. These reactions are reversible with alternating voltages. Changes in the gas resistance occur during the compression cycle and also varies with voltage amplitude.

My invention, in order to achieve its principal object, provides a high voltage impulse of short duration without alterations so as not to modulate, aid, or oppose succeeding impulses or interfere with the leading edge of the successive wave forms. These requirements are essential in variable speed engines where changing loads and shrinking time intervals cause ignition voltages to run into each other.

This invention derives such a wave form from the ignition voltage surges, and oscillations which develop in the ignition transformer when the circuit breaker or switch means interrupts current flow. The invention gates the first and largest surge developed, confining the remainder to the ignition transformer, where it is summarily dealt with, thereby extending the quiescent interval between impulses at the output.

Thus, the invention creates an ignition voltage wave form, permitting precise timing for a consistent burn without delivery loss to the gas, and a system that does not require supressors or eliminators.

Another object is to provide voltage stabilization and regulation for a consistent output in the full r.p.m. range of the engine.

Still another object is to produce a voltage wave form that provides a higher input voltage with less current requirements, reducing the effects of minor resistance changes that cause voltage drops, thereby extending the life of the ignition components. The new wave form matches the switching action, increasing the efficiency of dwell time and extending the required necessary intervals between impulses for better timing regulation.

A further object is to provide visual means to indicate the functioning of the ignition system.

GENERAL DESCRIPTION

The objects of this invention will be best understood by reference to the accompanying drawings which disclose the preferred form of embodiment of the invention, and in which.

Figure 1:
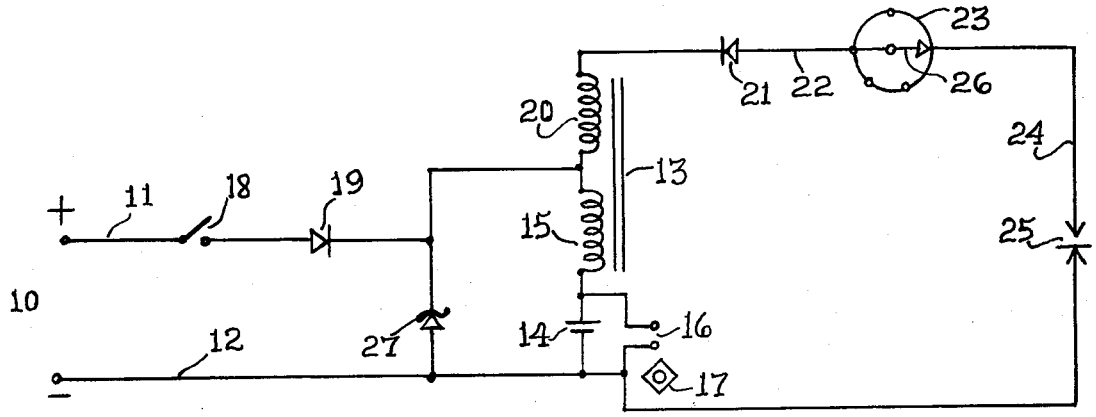
FIG. 1 is a schematic circuit diagram of the improved ignition system.

Referring to FIG. 1, there is shown a power source 10 having an input circuit consisting of lines 11 and 12, respectively, connected to the negative and positive terminals of the power source 10. The input circuit consisting of lines 11 and 12 is connected to the auto transformer 13 and includes a capacitor 14 connected in series with the primary 15 of the transformer 13. This capacitor 14 is shunted by a switch means 16 which represent the breaker points of an internal combustion engine which are actuated by a suitable camming trigger 17.

In the line 11 of the input circuit there is included an ignition on-off switch 18, as well as a gate diode 19. Also included in the input circuit of FIG. 1 is a Zener diode 27, which functions to shunt the primary circuit of the transformer 13 so as to regulate and stabilize the circuitry to a predetermined voltage level.

In the output circuit there is connected in series with the secondary winding 20 of the transformer 13 a gate diode 21 that is in turn connected by a line 22 to the distributor means 23, which is selectively connected through line 24 to sparking devices 25.

When the ignition switch 18 and the switch means 16 are closed, the current drawn from the power source 10 flows through the line 11 and the diode 19, the primary side 15 of the transformer 13, and the switch means 16, to develop the ignition voltage in a well-known manner. The power drawn for this initial impulse may be from two to four amps. On the opening of the switch means 16, surge and oscillatory voltages develop in a transfer of energy between the capacitor 14 and the transformer 13, so as to form a series resonant circuit providing reactive power. The surge voltage across the primary 15 and through the capacitor 14 may be as high as 250 v. and may be normally dissipated in time in the power source and any auxiliary circuits associated therewith. However, in the present circuit the presence of the diode gate 19 prevents this loss of energy and instead causes it to be stored in the capacitor 14 and inductance while the switch means 16 is open. The input circuit becomes biased and places a bias on the diode 21 of the output circuit, after it has gated through the first surge impulse of the required polarity, into the distributor means 23.

In the wasted interval of the switch means 16 opening, the energy for the next impulse has been formed and accounts for a new wave form produced in the input circuit. On the next closing of the switch means 16, the stored energy is discharged to develop the next impulse with a higher voltage, and therefore less current requirement. In effect, the role of the switch means 16 becomes reversed for a period of time.

It should be noted that a convenient method of duration change, rise time, or amplitude is available by a change in the value of the capacitor 14, and this will alter the resonant frequency. A change in rise time may be important to the choice of fuels and their chemistry. The output of the resonant circuit becomes a shock-excited single impulse instead of a ringing oscillatory voltage.

A reduction of current requirement after the first impulse in the input circuit extends the life of the parts and reduces the element of failure thereof.

Figure 2:
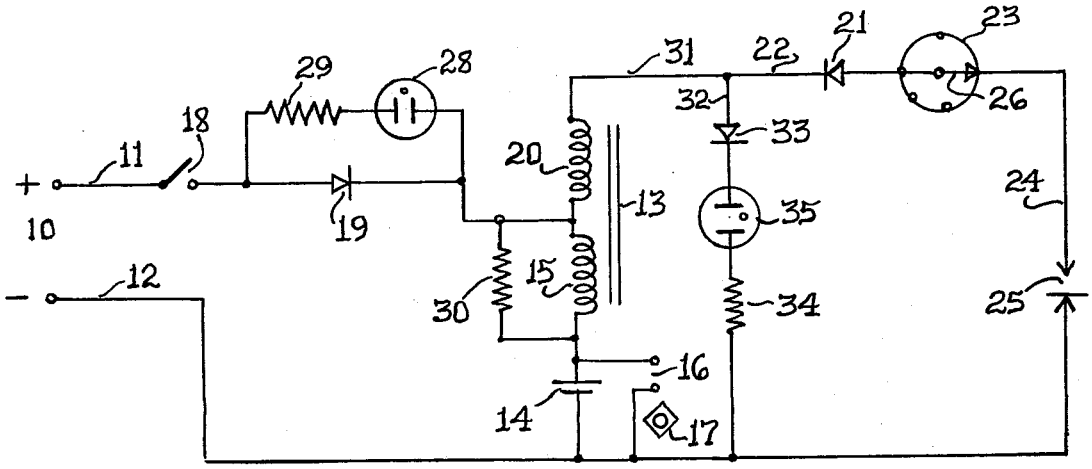
FIG. 2 is a schematic diagram of a modified circuit embodying the invention.

In FIG. 2, the function of the circuitry is much the same as that of FIG. 1, producing the same results with the exceptions hereinafter noted.

In the schematic circuitry of FIG. 2, it is noted that in the input circuit the Zener diode 27 is replaced with a gaseous lamp 28 and a series resistance 29, which will function as current limiting means and as a means of altering lamp intensity.

Also in the circuit of FIG. 2, there is added a resistance 30 which shunts the primary 15 of the transformer 13, but which is functional when the switch 16 is closed, thus serving to dampen oscillations.

As shown in the circuit of FIG. 2, there is connected to the line 31, which extends from the secondary winding 20 of the transformer 13 to the gate diode 21, a line 32 which forms a series circuit consisting of diode 33, a resistance 34, and a gaseous lamp 35.

Gaseous lamps have known characteristics which function as regulation and stabilization means, as well as switch means, and have been known to be used as relaxing oscillators, simultaneously indicating system function. In the present system, the flicker rate of the gaseous tubes indicates idle r.p.m.s, the presence of ignition voltages, and switch means' performance.

In this series circuit, the diode 33, resistance 34 and the gaseous lamp 35 function as a regulator and stabilization means, as well as for synchronizing purposes and a wave shaping means, while functioning as a visual indicator of the system's performance.

The conversion circuitry, as shown in FIG. 2, is in the output circuit of the improved ignition system, and the parts described as the diode 33, the resistance 34, and the gaseous lamp 35, shunt the transformer 13 and provide an additional signal voltage, and function to control voltages and as a means of synchronization thereof. The signal developed in this circuit provides as much as 500 V.D.C. without amplifiers or additional pulse forming circuitries. The gaseous lamp 35 may function as a relaxation oscillator for multiple frequencies for synchronization purposes or as a means of wave shaping, while functioning as an indicator of the system's performance.

It should be noted that the output pulse of this circuit is sufficient for shock excitation of radio frequency resonant circuits to provide for that form of energy to produce chemical reactions in the fuel-air mixture sought to be burned by the spark of the ignition system. This output pulse has a wave form that is compatible with the pulse created by the diode 21 so as to constitute a suitable means for providing the output of this circuit as a conversion or modification means for other systems providing surge and oscillatory outputs.

The function of the voltage regulator and stabilizing means is to overcome the fall-off of ignition voltages that result with increasing speeds and loads, and to dampen the oscillations in the transformer.

Figures 3A, 3B, 3C, 3D:
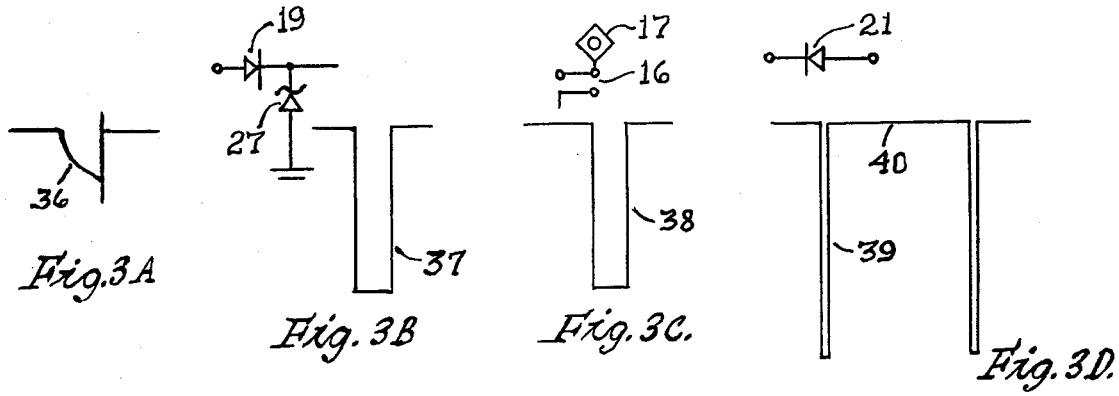
FIGS. 3A through 3D are schematic representations of wave forms developed within the improved circuit.

Referring to FIG. 3A, there is shown the wave form 36 present at the power source 10, while FIG. 3B discloses the wave form 37 resulting from the present function of the diode 19 and Zener diode 27, which is the input to the transformer 13.

FIG. 3C shows the wave form 38 during the functioning of the switch means 16, while FIG. 3D discloses the wave form produced by the output of the diode 21 going to the distributor means 23.

It should be noted from FIG. 3B that the wave form 37 at the input to the primary 15 of the transformer 13 matches the wave form 38 shown in FIG. 3C at the switch means 16, thus indicating a gain in dwell time efficiency.

FIG. 3D discloses the new wave form 39 which includes the extended quiescent interval 40 which is without sustaining voltages, as clearly shown, and which is the result of the function of the output circuit of the invention including the gating diode 21.

The matching wave forms and the resulting new wave form shown in FIG. 3D enable this circuit to achieve the stated objects of this invention.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. In an ignition system as used with a gas internal combustion engine comprising (a) an ignition circuit including a power source and an on-off switch, (b) an ignition coil having a primary and secondary winding, (c) switch means adapted to close and open between said power source and said primary winding of said ignition coil and adapted when open and closed to develop surge and oscillatory voltages therein, (d) a capacitor connected in series with said primary winding of said coil and adapted to be shunted by said switch means so as to be responsive to said switch means' open condition to prevent electrical current flow in said primary winding of said ignition coil from said power source and to permit electrical current flow when said switch is in its closed condition, (e) means in the circuit between said power source and said ignition coil cooperating with said capacitor for preventing dissipation of the surge and oscillatory voltages in said circuit during the open condition of said switch means through said ignition circuit and said power source, (f) a gaseous lamp and series-protective resistance in the circuit between said power source and said ignition coil for regulating and stabilizing the voltage developed therein, (g) distributing means in the output of said secondary winding of said coil, and (h) means in the output of said secondary winding between said coil and said distributing means converting the voltage of the output of said secondary winding to a single unidirectional high voltage impulse to said distributing means immediately followed by a quiescent interval for each ignition period.

2. In an ignition system as defined by claim 1, wherein said means in the circuit between the power source and said ignition coil comprises a zener diode connected in parallel to said series-connected capacitor and said primary winding of said ignition coil for regulating and stabilizing the voltages developed therein.

3. In an ignition system as used with a gas internal combustion engine comprising (a) an ignition circuit including a power source, (b) an ignition coil with primary and secondary windings, (c) means in said circuit for periodically initiating ignition voltages in the primary winding of said ignition coil and providing surge and oscillatory voltages at the output of said secondary winding of said ignition coil, (d) distributing means including switch means connected in circuit with said secondary winding of said ignition coil, (e) means connected between said secondary winding and said distributing means converting said surge and oscillatory output to a single unidirectional impulse immediately followed by a quiescent interval for each ignition period, (f) a gaseous lamp connected between said secondary winding of said ignition coil and said distributing means for regulating and stabilizing said output of said secondary winding, (g) and a diode connected in series with said gaseous lamp indicating the plurality of said voltages of the output of said means converting said output of said secondary winding of said ignition coil.

4. In an ignition system as used with a gas internal combustion engine comprising (a) an ignition circuit including a power source, (b) an ignition coil with primary and secondary windings, (c) switch means adapted to periodically interrupt current flow through said primary winding of said ignition coil from said power source and for developing surge and oscillatory voltages in its open condition at the output of said secondary winding, with said surge and oscillatory voltages being reflected back to the primary winding of said ignition coil, (d) distributing means connected in circuit to the output of said secondary winding, (e) means connected between said power source and said primary winding of said ignition coil adapted to cause a polarity of said surge and oscillatory voltages to be stored in said primary winding of said ignition coil during the open condition of said switch means and discharged on successive closing of said switch means, and to prevent dissipation of voltages of said polarity in said circuit and power source of said ignition system, and (f) means for regulating and stabilizing the voltages of said polarity including a gaseous lamp connected between said power source and said storage means and adapted to indicate the presence and polarity of said stored voltages.

* * * * *